United States Patent [19]

Mallek et al.

[11] 4,116,136

[45] Sep. 26, 1978

[54] METHOD OF AND FURNACE FOR BURNING WASTE MATERIAL

[75] Inventors: Heinz Mallek; Werner Jablonski, both of Linnich, Tetz; Peter Pelzer, Niederzier, Obz., all of Fed. Rep. of Germany

[73] Assignee: Kernforschungsanlage Jülich, Gesellschaft mit beschrankter Haftung, Jülich, Fed. Rep. of Germany

[21] Appl. No.: 764,915

[22] Filed: Feb. 2, 1977

[30] Foreign Application Priority Data

Feb. 5, 1976 [DE] Fed. Rep. of Germany ..... 2604409

[51] Int. Cl.[2] ..... F23G 5/12

[52] U.S. Cl. ..... 110/251; 110/255; 110/346

[58] Field of Search ..... 110/8 R, 8 A, 8 C, 11, 110/15, 29

[56] References Cited

U.S. PATENT DOCUMENTS

| | | | |
|---|---|---|---|
| 3,641,952 | 2/1972 | Wotschke | 110/8 C |
| 3,680,503 | 8/1972 | Danielsson et al. | 110/29 |
| 3,697,256 | 10/1972 | Engle | 110/15 |
| 3,707,129 | 12/1972 | Kawashimo et al. | 110/15 |

FOREIGN PATENT DOCUMENTS

| | | | |
|---|---|---|---|
| 894,742 | 10/1953 | Fed. Rep. of Germany | 110/29 |

*Primary Examiner*—Kenneth W. Sprague
*Attorney, Agent, or Firm*—Walter Becker

[57] ABSTRACT

A method of and furnace for burning waste material, according to which the waste material is for drying and degasifying same heated in a container whereupon the thus degasified waste material and the waste gases formed during such heating and drying operation are burned in a combustion chamber directly following the container while fresh air is added to the degasified waste material and to the waste gases formed during the heating operation. The heating of the waste material in the container is effected under exclusion of air, and the thus formed waste gases together with the degasified waste material are passed through a constriction located between the container receiving the waste material to be burned and the combustion chamber, the fresh air being added to the degasified waste material and to the waste gases at the constriction.

5 Claims, 1 Drawing Figure

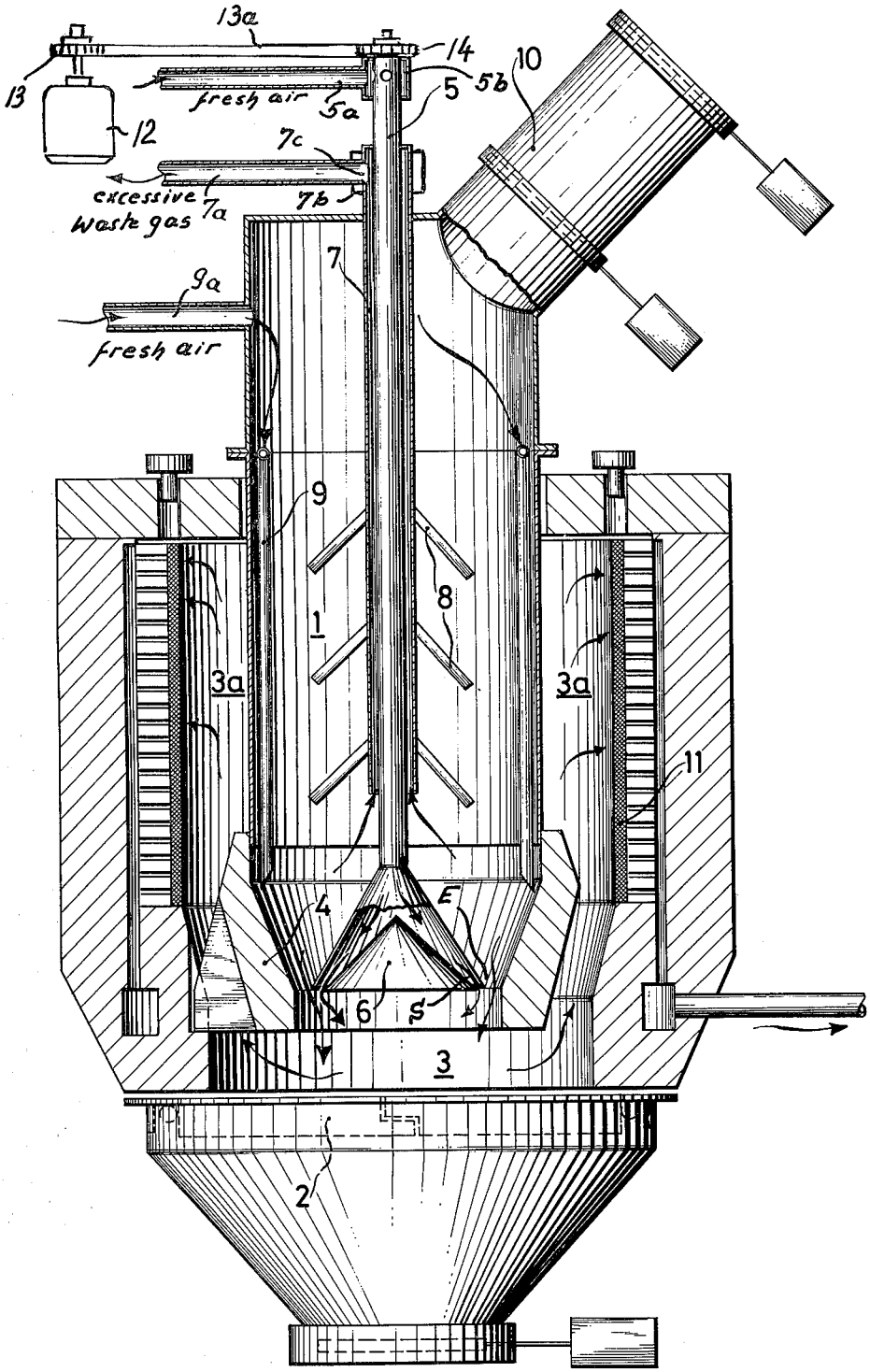
13a
14
10
13
fresh air
5a
5
5b
12
7c
excessive
waste gas
7a
7b
7
9a
fresh air
9
8
1
3a
3a
11
4
E
6
S
3
2

METHOD OF AND FURNACE FOR BURNING WASTE MATERIAL

The present invention relates to a method of and furnace for burning waste, according to which the waste gases are burned in a combustion chamber while fresh air is added to the waste. The furnace according to the invention is provided with a central chute for receiving the waste, with a combustion chamber which is arranged below said chute and has a closed bottom while the combustion chamber is provided with fresh air feeding lines provided in that portion of the combustion chamber which is directly adjacent said chute, while the flue gas formed in the combustion chamber is through exit openings in the draft chamber of the combustion chamber conveyed to a flue. A method of the above mentioned type has become known and discloses a furnace of the above mentioned type for practicing said method. This known method and the furnace for practicing said method are characterized by a particularly good combustion of the waste, especially also of the gases formed during the combustion which fact is due in particular to the supply of fresh air to the formed waste gases. This known method, however, has the drawback that when charging said furnace with waste in charges, depending on the size of the furnace, already at waste quantities above a few kilograms, an irregular combustion of the waste cannot be avoided. This is due in particular to the fact that the waste when introduced into the combustion chamber at a temperature of approximately 800° C, will in view of its relatively large reaction surface gasify spontaneously thereby at a too strong gas development causing a considerable interference with the air-gas mixture. This will result in a poor combustion and considerable soot formation.

It is, therefore, an object of the present invention to provide a method and furnace of the above mentioned type according to which, also with a non-uniform charging of waste in the furnace, a uniform combustion of the waste will be assured while at the same time in a simple and economic manner the temperature required for the combustion will be held substantially steady.

These and other objects and advantages of the invention will appear more clearly from the following specification in connection with the accompanying drawing diagrammatically illustrating a furnace according to the invention.

According to the method of the invention for burning wastes, the waste is for purposes of drying and de-gasifying heated in a chamber receiving the waste, and the waste and the waste gases formed during the drying and de-gasifying operation is burned in a combustion chamber which directly follows the chamber receiving the waste. The said method is in conformity with the present invention characterized primarily in that the wastes while closing off the air heated in the chamber receiving the waste, and the waste gases formed in connection therewith together with the de-gasified waste for combustion is conveyed to a constriction provided between the chamber receiving the waste and the combustion chamber, while at said constriction fresh air is admixed to the waste gases and to the degasified waste.

Expediently, the flue gases withdrawn from the combustion chamber are used for heating the waste.

Another method is known according to which the waste is prior to its combustion proper dried, degasified and melted. This brings about that the combustion is practically independent of the waste charging. For practicing this known method, combustion furnaces known as high combustion installations are likewise known from the above mentioned publication, according to which waste is pretreated in the above mentioned manner and is subsequently burned. This method and the combustion furnaces employed in connection therewith have the drawback that a uniform heat balance is rather difficult to obtain because with said heretofore known combustion furnaces, a high calorie supply is necessary in order to maintain the temperatures continuously above the average melting point. In order to realize this, with the heretofore known combustion furnaces, fuel materials with high calorie content are admixed to the waste in order to realize that the heat value of the material to be burned lies about 2000 kcal/kg. The combustion air is heated in cowper stoves (air heaters) to 1000° C which, however, requires too high investments. Furthermore, it has been suggested instead of air, to introduce oxygen into the combustion processes in order in this way to avoid the heating up of the nitrogen of the air. Such a step, however, adds to the investment cost as well as to the cost of operation. In contrast thereto, according to the method of the invention, the material to be burned — the pre-dried, heated and in connection therewith de-gasified waste, and the waste gases formed during the de-gasifying process — as well as the fresh air conveyed for maintaining the combustion are conveyed to a common station, the constriction, whereby it will be possible in a simple manner, namely by controlling the supply of fresh air and/or by varying the speed, at which the wastes are conveyed to said constriction, to adjust and select the conditions which are best for the combustion process.

The transition area designed as constriction and provided between the waste receiving chamber and the combustion chamber is, in conformity with the present invention, depending on the type of the waste, so dimensioned that the waste will accumulate about the constriction. The combustion of the waste is therefore effected at the constriction itself where fresh air is admixed to the degasified waste and to the waste gases created during the degasification. From the constriction, individual waste particles may fall downwardly into the combustion chamber. The combustion of the waste is thus effected in conformity with the present invention in a manner similar to the situation with a burner, according to which the fuel is combined with the air necessary for the combustion.

A particularly advantageous further development of the method according to the invention consists in that heated up fresh air at a below stoichiometric quantity ratio is conveyed to the heated waste and to the waste gases ahead of said constriction. In view of the supply of fresh air the temperature of which should be at least 300° C, it will be realized that the waste material ahead of said constriction will be burned partially, and the degasification of the waste material will be intensified in connection therewith. The quantity of the fresh air which is conveyed above the constriction will with regard to the quantity of fresh air directly conveyed to said constriction be at a ratio which has been balanced with regard to an optimum combustion behavior of the furnace. By changing this quantity ratio, it will be possible in a simple manner to control the combustion and thus to determine the burning behavior. In view of the high gas proportion at the constriction, it will be possible in the combustion chamber to reach temperatures of about 1,500° C if a slag belt is desired.

A further advantageous development of the method according to the invention consists in that a portion of the waste gas generated during the degasification of the waste is withdrawn from the chamber receiving the waste. Also in this way, it will be possible to withdraw from the combustion excessive gases which are not necessary for the combustion of the waste. This has the additional advantage that the excessive waste gases can be employed for external combustion processes.

In case that waste which is difficult to burn, for instance waste sludge, is to be burned, it will also be possible to convey gases for instance methane containing natural gas, aiding the compression to the heated waste and waste gases ahead of the constriction.

The problem underlying the present invention is furthermore solved by a combustion furnace of the above mentioned type which serves for practicing the method according to the invention and according to which the transfer between the central chute and the combustion chamber is designed as constriction air into which the fresh air conveying conduits lead, the withdrawing chamber being so designed that it surrounds the central chute while in the chute there is provided a device for moving the waste.

Due to the fact that the withdrawing chamber of the combustion chamber comprises the central chute, the waste present in the chamber formed by the chute is heated without the necessity of providing an additional supporting heating system. Due to the device for moving the waste, the waste material piled up will be shifted whereby the heating of the waste material is aided. At the same time, it will be realized that the wastes due to gravity are conveyed to said constriction. This constriction, depending on the type of waste and in conformity with the actuation of the device for moving the waste, is so set that the waste will accumulate above the constriction.

According to a further advantageous development of the combustion furnace according to the invention, fresh air feeding lines lead into the lower portion of the chute above the said constriction.

As a result thereof, it is possible to carry out a modification of the method according to the invention, according to which modification ahead of the constriction, fresh air is conveyed at a below stoichiometric quantity ratio to the heated waste and to the waste gases for the partial combustion thereof and for the degasification.

A further development of the combustion furnace according to the invention consists in that conduits extending from the outside into the chute and connectable to a withdrawing device or a combustion gas supply lead into the lower portion of the chute. This makes it possible selectively to withdraw from the combustion a portion of the waste gases formed during the degasification of the waste or, when waste difficult to burn is to be burned, to convey combustion aiding gases to the waste.

The FIGURE is a vertical sectional view of the combustion furnace.

Referring now to the drawing in detail which illustrates an embodiment of the combustion furnace according to the invention, it will be seen from the drawing that the combustion furnace has a central chute 1 below which there is provided a combustion chamber 3 which is adapted to be closed at its bottom by means of a flap 2. The combustion chamber 3 has a withdrawing chamber 3*a* which surrounds the central chute 1. The chute 1 is followed by a furnace muffle 4 which conically tapers in downward direction. A member 5 the lower end of which widens conically extends into the chute 1 from above. The element 5 at the lower end of chute 1 forms with the muffle 4 at the transgression area to the combustion chamber 3 a constriction designed as annular gap. The gap width of said constriction is variable depending on the position of the element 5, which is adjustable as to height. In the widened area of the element 5 which has its lower end designed in a tubular manner, there is provided a cone 6 in such a way that it forms slots with the tubular element at the lower end thereof, said slots facing said constriction area.

As will furthermore be seen from the drawing, the tubular element 5 is coaxially surrounded in radially spaced relationship by a pipe 7 which from the outside extends into the chute 1 and forms a conduit leading into the lower portion of the chute 1. On the pipe which forms the conduit 7, there are provided rod-shaped members 8 which extend into the chute-like chamber formed by the chute 1 and the furnace muzzle 4. Furthermore, on the inner wall of the chute 1 there are provided pipes 9 which at their upper end extend beyond the height of the withdrawing chamber 3*a* while the lower end of said pipe 9 is located at the upper portion of the muffle 4.

When practicing the method according to the invention, the chute 1 is filled up to about the level of the withdrawing chamber 3*a* with waste introduced through a charging box 10. The supply of fresh air is effected on one hand through the slots S directly to the constriction area E, said slots being provided at the lower portion of the tubular member 5, and on the other hand fresh air is introduced at the upper portion of the chute 1 through the conduit 9*a*. The fresh air conveyed to the upper portion of the chute 1 does not pass through the tightly packed column of waste, but is rather heated up via the pipes 9 in which it is heated up similar to the fresh air passed through the member or element 5 and rather passes into the lower portion of the column where it brings about a partial combustion and degasification of the waste material. In that portion of the column of waste which is located at the level of the pipes 9, the waste material is practically closed against air, but passes through an intensive drying and degasification phase since the central chute 1 is heated by the hot flue gases which flow through the withdrawal chamber 3*a* surrounding said chute 1. If the combustion furnace is in thermal balance, the member 5 is by means of a drive presently explained placed in a rather slow rotational movement.

This drive comprises a motor 12 drivingly connected to a sprocket wheel 13 which through a chain 13*a* is drivingly connected to a sprocket wheel 14 keyed to the tubular element 5 which latter is rotatable by the drive 12, 13, 13*a* and 14. That end of element 5 which is adjacent sprocket wheel 14 is closed while near said end, element 5 is provided with a plurality of transverse bores 5*b* which successively communicate with the fresh air inlet conduit 5*a* during the rotation of tubular element 5 relative to the sleeve 5*b* which normally is held stationary together with conduit 5*a*. However, element 5 with sleeve 5*b* is vertically adjustable together with element 5 to vary the width of constriction E.

Pipe 7 which has its upper end closed is connected in any convenient manner, e.g. by welding, to element 5 so as to rotate together with the latter when element 5 is rotated. Pipe 7 is similar to element 5 provided with one or more radial bores 7*c* for successive communication through stationary sleeve 7*b* with the outlet conduit 7*a*.

Due to the member 8 laterally extending into the waste column, the waste material is moved around and thus prevents a bridge formation and the formation of nests of incompletely burned gases. This will on one hand aid the degasification process while on the other hand by changing the speed of rotation of the member 5, the supply of waste material to the constriction will be controlled.

In the particular instance illustrated in the drawing by arrows, the excessive waste gases are withdrawn through conduit 7, 7*a*. However, it is also possible to convey combustion gases through the conduit 7 to the waste gas.

Not burned components which drop to the ash bed which is provided on the flap 2 are contacted by the hot gas current which still contains oxygen, and are burned completely. These burned substances are during a continuous operation of the furnace at intervals of from 1 to 2 days removed from the furnace.

The solid particles which are floatingly carried in the flue gases deposit on filter mats 11 provided at the exit of the withdrawal chamber and are here likewise burned by the oxygen still present in the hot gases. The filter mats 11 consist of pressed mats of fibers of a thickness of about 0.003 mm and have a thickness of about 10–15 mm.

In a furnace corresponding to the combustion furnace illustrated in the drawing there was burned waste material having a calorie content of about 1,500 kcal/kg and consisting of animal carcasses, papers and moist leaves, while the furnace was held at a thermal balance at a temperature within the range of from 800° C to 1200° C in the combustion chamber.

It is, of course to be understood that the present invention is, by no means, limited to the specific showing in the drawing, but also comprises any modifications within the scope of the appended claims.

What we claim is:

1. A method of burning waste material, which includes in combination the steps of: heating said waste material while preventing access of air thereto to thereby form waste gases and degasified waste, passing in a flow the thus formed waste gases and degasified waste to an area of combustion and constricting said flow in a location prior to its reaching said area of combustion while admixing fresh air to said flow where said flow is being constricted so that by way of admixing fresh air to the constricting location both the waste gases and degasified waste are combusted in common at the constricting location, said fresh air being added to flow at a below stoichiometric quantity ratio.

2. A method in combination according to claim 1, which includes the step of withdrawing a portion of said waste gases downwardly through the constricting location where they are being formed so that waste is held back above the constricting location to avoid passage therethrough except for ash particles and smaller coke parts.

3. A furnace for burning waste material, which includes: container means for receiving the waste material to be burned, said container means having a lower open end, a combustion chamber arranged below said lower end and provided with a normally closed bottom, first conduit means connectable to a source of fresh air and substantially extending coaxially with and through said container means into the vicinity of said combustion chamber, a furnace muffle extending from said lower open end of said container means to said combustion chamber and with said first conduit means defining a constriction, said first conduit means leading to said constriction, flue means surrounding said container means and communicating with said combustion chamber for releasing waste gases therefrom, and rotatable means arranged in said container means for aiding the movement of the waste material to be burned through said container means.

4. A furnace according to claim 3, which includes second conduit means connectable to a source of fresh air and arranged inside said container means in axial direction of said container means while ending in the vicinity of and above said constriction.

5. A furnace according to claim 3, which includes additional conduit means extending from the outside of said container means into and to the lower end of said container means and connectable selectively to a gas withdrawing device or a fuel gas supply.

* * * * *